United States Patent [19]

Root

[11] B 3,988,061

[45] Oct. 26, 1976

[54] PRESSURE FIXING OF TONERS

[75] Inventor: Russell L. Root, Shaker Heights, Ohio

[73] Assignee: Addressograph Multigraph Corporation, Cleveland, Ohio

[22] Filed: Aug. 1, 1974

[21] Appl. No.: 493,501

[44] Published under the second Trial Voluntary Protest Program on February 3, 1976 as document No. B 493,501.

[52] U.S. Cl. ..... 96/1 SD; 100/176; 118/637; 355/3 DD; 427/22; 427/444

[51] Int. Cl.[2] ..... G03G 13/00

[58] Field of Search ..... 355/3 DD, 3 FU, 17; 118/637; 100/161, 176; 96/1 SD; 427/22, 444

[56] References Cited

UNITED STATES PATENTS

| | | | |
|---|---|---|---|
| 3,598,579 | 8/1971 | Robinson | 355/3 |
| 3,655,282 | 4/1972 | Tuner et al. | 355/3 FU |
| 3,846,151 | 11/1974 | Roteman et al. | 118/637 X |
| 3,854,975 | 12/1974 | Brenneman | 118/637 X |
| 3,874,894 | 4/1975 | Pedersen | 355/3 DD |

*Primary Examiner*—R.L. Moses

[57] ABSTRACT

Electroscopic toner powders deposited in an image pattern configuration on a substrate are fixed in place thereon by applying pressure in the absence of heat. This is accomplished by applying pressure in a degree normally insufficient to secure adequate fixing, but by repeating the treatment one or more times, adequate fixing is achieved.

4 Claims, 3 Drawing Figures

PRESSURE FIXING OF TONERS

BACKGROUND OF THE INVENTION

Pressure treatment of electroscopic toners is an efficient way of fixing them to substrate sheets such as paper. It is inexpensive in equipment required, uses small quantities of power and can be effected at high speeds. Detailed information with regard to this process as carried out in connection with sheets of ordinary width is found in a copending patent application of Brenneman et al., Ser. No. 340,600 filed Mar. 12, 1973.

The pressures required in connection with this type of fixing vary in accordance with the properties of the toner used and the rolls used in applying the pressure may be loaded in varying degrees to accommodate these toner variations. As a practical matter this loading is usually found to lie somewhere in a range of 200 to 500 pounds per lineal inch of roll length (pli).

One of the problems associated with pressure fixing is the design of equipment which is able to withstand these loadings for long periods without mechanical breakdown, so that any arrangement which allows the use of a lower pressure with any particular toner contributes to a more reliable and service-free construction.

SUMMARY OF THE INVENTION

According to the present invention it has been discovered that for some reason, not currently apparent, adequate pressure fixing can be effected by plural pressure treatment steps in which, at each step, pressure is applied at a level inadequate to achieve fixing normally. Somehow, these plural treatments in series, using lower than adequate pressure, bring about a fixing of the toner in a degree which is the full equivalent of that achieved when the toner is subjected to a single treatment at higher pressure.

The series treatments may be arranged in a number of ways. Of primary interest are the following which will be discussed in detail hereinafter:

1. Passing the toned sheet between sets of pressure roll pairs in tandem.
2. Passing the toned sheet first between a pair of pressure rolls, and recirculating the sheet to pass it again between the same pair of roll.

DETAILED DESCRIPTION OF THE INVENTION

Figure 1:
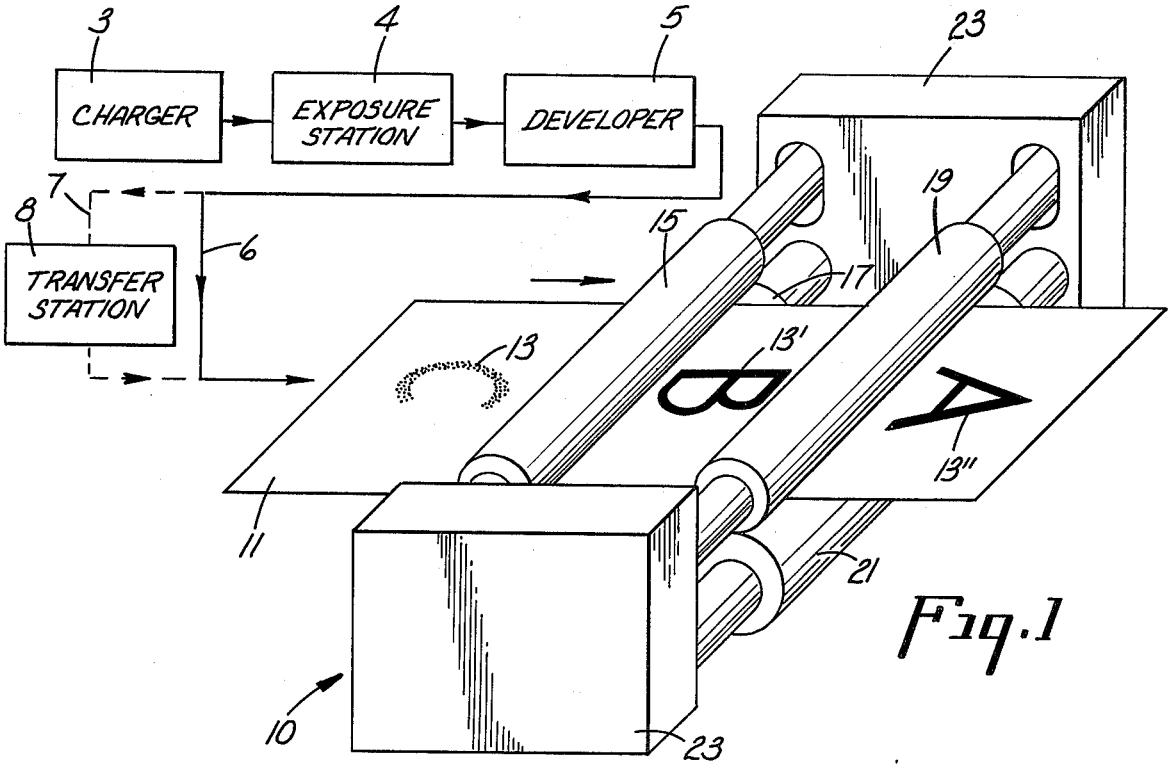
FIG. 1 is a perspective view of one manner of carrying out the present invention using tandem rollers, the preliminary image forming operations being indicated in block diagram form.

During the running of certain early tests related to pressure fixing of toners on substrates, it occurred that one series of samples was subjected to insufficient pressure to fix the toner in place so that it could be rubbed off with comparative ease. Inadvertently one of the samples was passed between the rollers twice, and it was noted that this sample differed from the others in requiring so much more rubbing force to remove toner that it could be considered to be substantially fixed.

To investigate this phenomenon a test procedure was initiated as follows:

1. Specific test toner and substrate materials were selected as standards for the test.
2. A mechanically standardized rub test was adopted, (referred to as a Crockmeter test) and a calibration was obtained which indicated that at readings of Optical Density of 0.55 or less, (taken on the surface of the rubbing cloth) the sample tested could be said to be a fully fixed image from the standpoint of commercial requirements.
3. A series of identical electrostatic images were formed on substrates and dusted with toner powder to form loosely held powder images.
4. The substrates were passed through the nip of a pair of pressure fixing rolls one or more times, the Crockmeter test applied, and the results recorded per the following table. The numeral in each case is the Crockmeter reading associated with the pressure in pounds per lineal inch (pli), and the pass number, found in the corresponding column and row, respectively.

| Pass No. | 175 pli | 200 pli | 225 pli | 250 pli | 275 pli | 300 pli |
|---|---|---|---|---|---|---|
| 1 | .96 | .76 | 70* | .64 | .61 | .47 |
| 2. | .76 | .63 | .58 | .52 | .52 | |
| 3 | .80 | .52 | .53 | | | |
| 4 | .67 | | | | | |

*This value was obtained approximately by interpolation since the omission was not discovered until after the test equipment was dismantled.

Each value in the above table is actually the average of plural runs.

From the foregoing table it can be determined with reasonable certainty that, using the selected toner and substrate, fixing will be obtained on the first pass at a pressure of 300 pli, and that a pressure of 285 pli is probably adequate for fixing on the first pass, by interpolation between the last two columns as follows:

| | |
|---|---|
| 300 pli − 275 pli | = 25 |
| .47 − .61 | = −.14 |
| .47 − .55 | = −.08 |
| 8/14 × 25 | = 14.3 |
| 300 − 14.3 | = 285.7 pli |

This value may be conveniently referred to as the "single-pass pressure" or the "threshold pressure" of the toner.

It is apparent that the image could be fixed on the second pass somewhere between 250 pli and 225 pli, and by similarly interpolating, this figure can be approximated as halfway between these pressures, or about 237.5 pli.

It is further apparent that the image would be fixed on the third pass somewhere between 200 pli and 175 pli, and, again by suitable interpolation, this figure can be approximated as being about 195 pli.

If we assume that 286 pli is the minimum loading of the rolls that can be relied on to fix the image with one pass under the conditions of the test, i.e. the threshold pressure, then it appears that electrostatic toner images can be fixed well below this value when two or three passes are used, apparently about 237.5/286, or 83 percent of threshold pressure when two passes are used, and about 195/286, or about 68 percent of threshold pressure when three passes are used.

It is then apparent that, by using plural passes, pressure fixing of the image can be achieved using pressure values materially less than the threshold pressure, by which is meant a difference of at least ten percent.

At pressure values materially below the three pass fixing pressure it becomes, apparently, a marginal question as to whether commercially acceptable fixing can be attained. The above chart shows, for example, that at 175 pli adequate fixing was not attained on the fourth pass. The test, was, in fact, continued at this pressure and the Crockmeter readings did not drop significantly below an Optical Density reading of 0.60 after ten passes, indicating that there is probably a pressure floor below which fixing cannot be obtained regardless of the number of passes used. In this case it appears to be approximately 185–190 pli.

The reason why a second or third application of pressure at a predetermined value will produce fixing of the toner powder when a single application thereof is ineffective is not at present understood, but the fact that this effect does occur has been clearly demonstrated by test, and this effect can be put to beneficial use as above described.

Referring to the drawing, FIG. 1 illustrates apparatus for performing the present invention in which one form of customary means for preparing the sheet is illustrated diagrammatically by a series of blocks in which there is provided a charger 3 for applying a blanket charge to the surface of an electroconductive member, an exposure means 4 through which the member passes to prepare an electrostatic image by light exposure, and developer means 5 for applying toner powder to the latent electrostatic image to render it visible. At this point, assuming that the electroconductive member itself is a flexible paper sheet which will become the final copy, it may, via path 6, pass directly to the fixing station 10. On the other hand, if the member does not form the final sheet, it is passed along path 7 to a transfer station 8 where the powder image is transferred to a receiving sheet which will form the substrate for the resulting copy. In either case the sheet or substrate, designated 11, is passed through the fixing station 10 to fix the powder image thereon.

In addition to the typical processes above described, it will be readily appreciated that other techniques for depositing toner particles on a substrate under the control of an electrostatic image pattern have been developed, and any of these are usable in conjunction with the fixing technique described in detail hereinafter.

In the form of this invention illustrated in FIG. 1, the fixing station comprises a first cooperating pair of pressure rolls 15, 17 and a second cooperating pair of pressure rolls 19 and 21. The roll pairs are mounted in side frames 23 and arranged with suitable adjustable spring means (not shown) to permit setting the desired pressure at the nip of each roller pair.

The sheet 11, carrying the powder image 13, either formed initially thereon or transferred thereto, is passed through the nips of the two roller pairs in sequence, the powder image assuming a semi-fixed state as indicated at 13' as it emerges from the first roller pair and a completely fixed state 13'' as it emerges from the second roller pair.

The central feature of the present invention relates to the pressure setting used with roll pairs 15, 17 and 19, 21. As has been demonstrated in the prior art, pressure alone applied at a certain level can achieve complete fixing of the toner particles to the substrate while avoiding the problems resulting from heat fixing such as the possibility of burning the substrate, slow operation, and high power requirements. For certain types of toner, certain substrates, or certain combinations of toner and substrate, however, experience has shown that rather high pressures may be required to achieve a degree of fixation which is commercially acceptable, and such high pressures entail their own drawbacks as heretofore stated. In any case, the use of a lower value of pressure at the fixing rolls is a distinct advantage to be sought.

It has been determined that the pressure setting which can be employed is materially less than that which would be required for single pass fixing. As an example, if the toner substrate combination selected were of such nature that a setting of 500 pli would be required on a single set of rolls to cause fixation of the image, then the rolls at the two nips 15, 17 and 19, 21 could be set at some pressure setting which is empirically determinable as effective for double pass fixing, perhaps about 425 pli. Then when the sheet 11 is passed through both nips, the fixing result would be the same as if the 500 pli pressure were applied to the sheet by a single roller pair.

The pressures applied at the two nips need not be precisely equal, but in any case the pressures can both be well below the single pass pressure, so long as each individual pressure setting is equal to or slightly above the empirically determined minimum double pass pressure.

While two roll sets have been shown in FIG. 1, it will now be apparent that three roll sets may be employed if desired, resulting in a further reduction in the value of pressure usable at each of the nips.

The roll sets are illustrated for convenience as being in spaced relation, but in actual construction a much closer proximity would normally prove beneficial, and the roll sets may be mounted as close together as mechanical limitations permit.

When the sheet 11 emerges from between the last set of rolls (19, 21 in FIG. 1) the image 13'' will be as firmly fixed as if the pressure settings had been at a level adequate to fix the image in a single pass.

Figure 2:
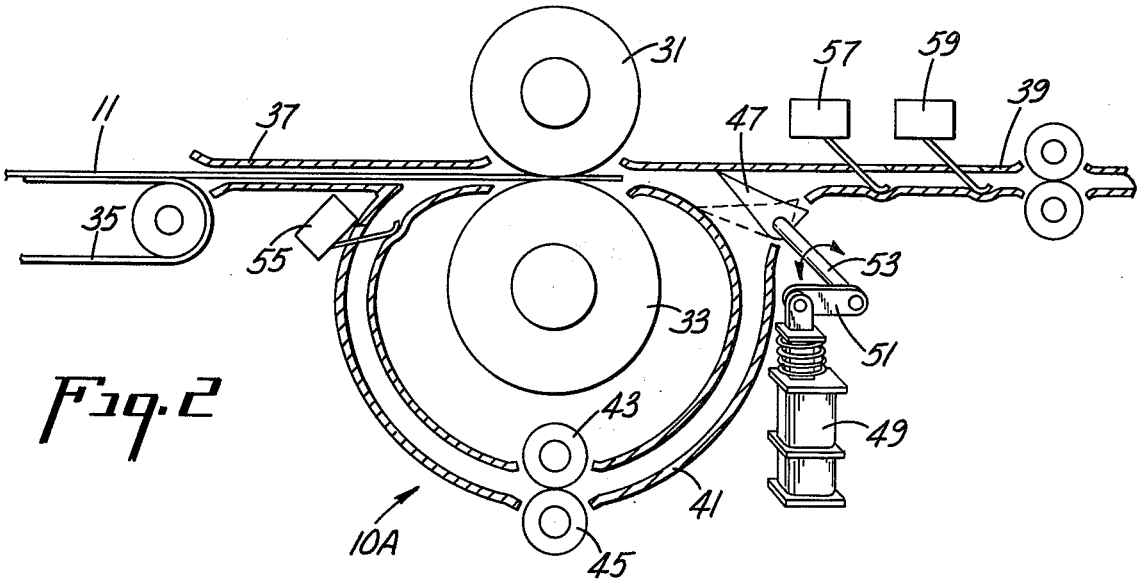
FIG. 2 is a diagrammatic elevation showing a construction adapted for recirculating a sheet to provide plural passes between the rolls of a single pair of pressure rolls.

FIG. 2 illustrates another form of fixing station 10A which can be substituted for the station 10 in the system of FIG. 1.

In this case there is provided a single set of rolls 31, 33 cooperating with guiding and control means for recirculating the sheet back through the roll nip two or three times.

A conveyor 35 moves the sheet 11 forward and introduces it into a guide 37 which leads it to the roll nip where it passes between rolls 31 and 33 receiving a first application of pressure.

Leading away from the roll nip is a departure guide means 39 and, branching therefrom a recirculating guide means 41 which is shaped to carry the sheet back to a location just ahead of the roll nip, and which merges with the guide 37 at that location. The guide 41 preferably includes one or more sets of powered forwarding rolls such as 43, 45 at appropriate points, since the length of guide 41 must be such as to have the trailing edge of a sheet clear the nip of rolls 31, 33 before the leading edge of the same sheet reaches the nip again.

A gate 47 is mounted at the juncture of guides 39 and 41, and is selectively settable to direct a sheet, approaching from the left in FIG. 2, into one or the other of said guides. Means are provided for operating the gate, shown in the form of an electric motor or solenoid 49 which drives a crank 51 affixed to shaft 53 to which the gate 47 is also affixed.

Three sensing sheet switches are shown, one at 55 for sensing the lead edge of a recirculating sheet as it approaches the nip of the pressure rolls 31, 33, a second at 57 located to sense when the trailing edge of a sheet has cleared the gate, and a third numbered 59 which tests for the presence of a sheet just downstream of the switch 57.

A pair of pull-out rolls 61, 63 are shown for forwarding the sheet away from the fixing station.

Figure 3:
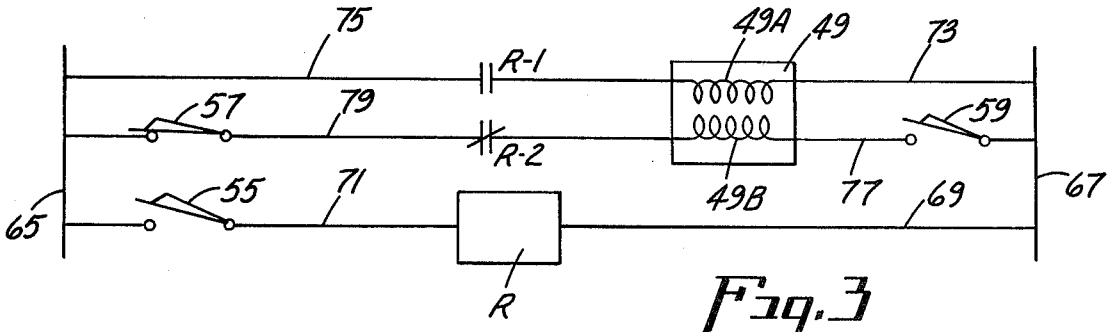
FIG. 3 is wiring diagram showing the electrical control circuit for the device of FIG. 2.

FIG. 3 shows a diagram of the control circuit for effecting dual pressure application on a sheet 11 as it passes through the fixing station, the circuit including the solenoid 49 and switches 55, 57 and 59 already described.

The power circuit is represented by the conductors 65 and 67, and between these is disposed the relay R connected across the power circuit by conductors 69 and 71. The latter conductor is interrupted by the normally open switch 55.

The solenoid 49 is shown as a latching solenoid having an activating coil 49A and latch release coil 49B, the former being served by conductors 73 and 75, the latter interrupted by normally open contacts R-1 of the relay R.

The unlatching coil 49B of the solenoid 49 is served by a conductor 77 which is interrupted by normally open switch 59, and conductor 79 in which are connected in series normally closed switch 57 and the normally closed contacts R-2 of the relay R.

Referring to FIGS. 2 and 3, it can be seen that as a sheet approaches the fixing station 10A the solenoid 49 will be inactivated so that the sheet will pass between pressure rolls 31, 33 and be guided into the recirculation path (guide 41). When its lead edge reaches the sensing switch 55, the latter will close, thereby activating solenoid R to close contacts R-1 and open contacts R-2. Closing contacts R-1 energizes the solenoid activating coil 49A and causes the solenoid to shift the diverting gate 47 to straight through position, and to become latched in that position. Thus when the leading edge of sheet 11 passes through the nip of rolls 31, 33 for the second time it will be directed into the guide 39 and away from the fixing station.

As the lead edge of the sheet first emerges from the nip it strikes sensing switch 57, placing it in an open position ready to sense ultimately the passage of the trailing edge of the sheet. It then strikes sensing switch

59, closing the same, but completing no circuit since the other switches in series are still open.

The trailing edge of the sheet first leaves switch 55, thereby deenergizing relay R and transferring the contacts R-1 and R-2 to original condition. This again is without immediate effect because solenoid 49 is latched and switch 57 is holding open the circuit through the unlatching coil 49B.

As the trailing edge of the sheet 11 clears switch 57, the circuit is completed through normally closed switch 57, normally closed contacts R-2 and still closed contacts 59, and the coil 49B is energized to unlatch the solenoid 49 and return the gate 47 to its normal position as shown in solid lines in FIG. 2, ready for the next sheet.

Finally the trailing edge of the sheet clears normally open switch 59 to leave the activating circuit for the unlatching coil in open position. This not only prevents a current drain during machine idling, but also avoids conflict between the latching and release coils as a sheet approaches, for the reason that latch release energization can never take place until the condition exists that, simultaneously, switch 59 is closed by the presence of a sheet, and switch 57 is closed by the absence of a sheet. This condition occurs only when the trailing edge of a departing sheet is between switches 57 and 59, so that switch 55 is unactuated and the activating contacts R-1 of the relay R are consequently open.

Relay contacts R-2 give double assurance that the coil 49B will not be energized at the same time that coil 49A is energized, but may be dispensed with if desired.

It will be understood that the form illustrated in FIGS. 2 and 3 can also be used to provide a triple pass condition if desired by introducing into the circuit a stepping switch to prevent exiting of the sheet until the third pass has been accomplished.

While two specific forms of equipment have been illustrated for achieving pressure fixing in two or three passes, it will be understood that this basic principle is capable of being effected in other ways, and that the description is not to be understood as limiting in this respect.

What is claimed is:

1. The method of providing a permanent image on a substrate, wherein the image is a fixed dry powder image of electroscopic toner powder having a predetermined threshold pressure and wherein fixing is achieved solely by the application of pressure applied to the powder image on the substrate, comprising:

the steps of creating an electrostatic charge pattern in image configuration;

depositing dry electrostatic toner powder upon said substrate to form an image pattern configuration under the electrical control of said charge pattern;

and fixing the toner power image to said substrate, wherein the last mentioned step includes:

a. applying to said imaged substrate a pressure less than said threshold pressure by means of an unheated pressure member; and b. repeating the procedure of step a) one or more times to ultimately pressure fix said powder image upon said substrate.

2. Apparatus for providing a permanent image on a substrate, wherein the image is a fixed dry powder image of electroscopic toner powder having a predetermined threshold pressure and wherein fixing is achieved solely by the application of pressure applied to the powder image on the substrate, comprising:

means for creating an electrostatic charge pattern in image configuration;

means for depositing dry electroscopic toner powder upon said substrate to form an image pattern configuration under the electrical control of said charge pattern; and means for fixing said toner power image to said substrate, wherein said last mentioned means includes:

means consisting essentially of unheated pressure members for exposing said imaged substrate to a series of at least two pressure applications in sequence, each such application being at a pressure value less than said threshold pressure.

3. Apparatus as set forth in claim 2 in which said last mentioned means comprises a plurality of pressure member sets arranged in cooperating relationship whereby the substrate passes through each one in turn.

4. Apparatus as set forth in claim 2 in which said last mentioned means comprises a single set of pressure members, and means for recirculating the substrate to receive a series of pressure treatments by said set.

* * * * *